US007300103B1

(12) United States Patent
Grays

(10) Patent No.: US 7,300,103 B1
(45) Date of Patent: Nov. 27, 2007

(54) CHILD BOOSTER WITH SPILLPROOF TRAY

(76) Inventor: Linda Grays, 144 S. Wedgewood Dr., San Diego, CA (US) 92114

( * ) Notice: Subject to any disclaimer, the term of this patent is extended or adjusted under 35 U.S.C. 154(b) by 79 days.

(21) Appl. No.: 11/080,940

(22) Filed: Mar. 14, 2005

Related U.S. Application Data

(60) Provisional application No. 60/552,889, filed on Mar. 15, 2004.

(51) Int. Cl.
*A47C 7/62* (2006.01)
*A47C 13/00* (2006.01)
*A47B 13/08* (2006.01)

(52) U.S. Cl. ..... 297/119; 297/129; 297/188.1; 297/188.2; 108/90

(58) Field of Classification Search ..... 297/250.1, 297/254, 256.16, 153, 148, 188.09, 188.1, 297/188.12, 188.13, 188.2, 119, 121, 124, 297/125, 129, 139, 140; 108/11, 26, 90
See application file for complete search history.

(56) References Cited

U.S. PATENT DOCUMENTS 2,019,005 A * 10/1935 Erickson ..... 297/36
2,540,685 A * 2/1951 Mayer ..... 297/182
2,544,896 A * 3/1951 Nidetch et al. ..... 297/250.1
2,704,116 A * 3/1955 Scanlon ..... 297/150
4,165,123 A * 8/1979 Hutson ..... 297/153
4,854,638 A * 8/1989 Marcus et al. ..... 297/256.11
4,867,504 A 9/1989 Johnson, Jr.
5,183,311 A * 2/1993 Meeker et al. ..... 297/151
D367,368 S 2/1996 Drane
5,609,389 A 3/1997 Longoria et al.
5,683,137 A * 11/1997 McDonald et al. ..... 297/217.3
5,829,627 A * 11/1998 Martindale ..... 220/666
6,343,837 B1 * 2/2002 Gage ..... 297/250.1
6,484,989 B1 * 11/2002 Connery ..... 248/311.2
6,773,064 B2 * 8/2004 Treen et al. ..... 297/255
6,932,426 B2 * 8/2005 Greger ..... 297/149

* cited by examiner

*Primary Examiner*—David Dunn
*Assistant Examiner*—Tania Abraham

(57) ABSTRACT

An apparatus for use in conjunction with feeding infants and toddlers. The apparatus is a two-part tool that combines a booster seat along with a spill-proof food tray that is removed and placed onto an adjacent table surface. The booster seat includes a small storage compartment that is located within the booster seat. The spill-proof food tray includes a separate cup holder area along with a catch-all tray that allows food to fall into it rather than onto a floor surface or onto an infant or toddler using the present invention.

4 Claims, 2 Drawing Sheets

CHILD BOOSTER WITH SPILLPROOF TRAY

I. CROSS-REFERENCE TO RELATED APPLICATIONS

This application claims the benefit of U.S. Provisional Application No. 60/552,889, filed Mar. 15, 2004.

II. BACKGROUND OF THE INVENTION

The present invention concerns that of a new and improved apparatus for use in conjunction with feeding infants and toddlers.

III. DESCRIPTION OF THE PRIOR ART

U.S. Pat. No. 5,609,389, issued to Longoria, discloses a booster seat with a tray incorporated, suited be placed on an adult seat to allow a child to eat or play.

U.S. Pat. No. 4,867,504, issued to Johnson Jr., discloses a booster seat allowing for adjustment to two different heights.

U.S. Pat. No. D367,368, issued to Drane, discloses an ornamental design for a booster seat with a tray.

IV. SUMMARY OF THE INVENTION

The present invention concerns that of a new and improved apparatus for use in conjunction with feeding infants and toddlers. The apparatus is a two-part tool that combines a booster seat along with a spill-proof food tray that is removed and placed onto an adjacent table surface. The booster seat includes a small storage compartment that is located within the booster seat. The spill-proof food tray includes a separate cup holder area along with a catch-all tray that allows food to fall into it rather than onto a floor surface or onto an infant or toddler using the present invention.

There has thus been outlined, rather broadly, the more important features of a combined booster seat and spill-proof tray that the detailed description thereof that follows may be better understood and in order that the present contribution to the art may be better appreciated. There are, of course, additional features of the combined booster seat and spill-proof tray that will be described hereinafter and which will form the subject matter of the claims appended hereto.

In this respect, before explaining at least one embodiment of the combined booster seat and spill-proof tray in detail, it is to be understood that the combined booster seat and spill-proof tray is not limited in its application to the details of construction and to the arrangements of the components set forth in the following description or illustrated in the drawings. The combined booster seat and spill-proof tray is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present combined booster seat and spill-proof tray. It is important, therefore, that the claims be regarded as including such equivalent constructions insofar as they do not depart from the spirit and scope of the present invention.

It is therefore an object of the present invention to provide a combined booster seat and spill-proof tray which has all of the advantages of the prior art and none of the disadvantages.

It is another object of the present invention to provide a combined booster seat and spill-proof tray which may be easily and efficiently manufactured and marketed.

It is another object of the present invention to provide a combined booster seat and spill-proof tray which is of durable and reliable construction.

It is yet another object of the present invention to provide a combined booster seat and spill-proof tray which is economically affordable and available for relevant market segment of the purchasing public.

Other objects, features and advantages of the present invention will become more readily apparent from the following detailed description of the preferred embodiment when considered with the attached drawings and appended claims.

V. BRIEF DESCRIPTION OF THE DRAWINGS

VI. DESCRIPTION OF THE PREFERRED EMBODIMENT

Figure 1:
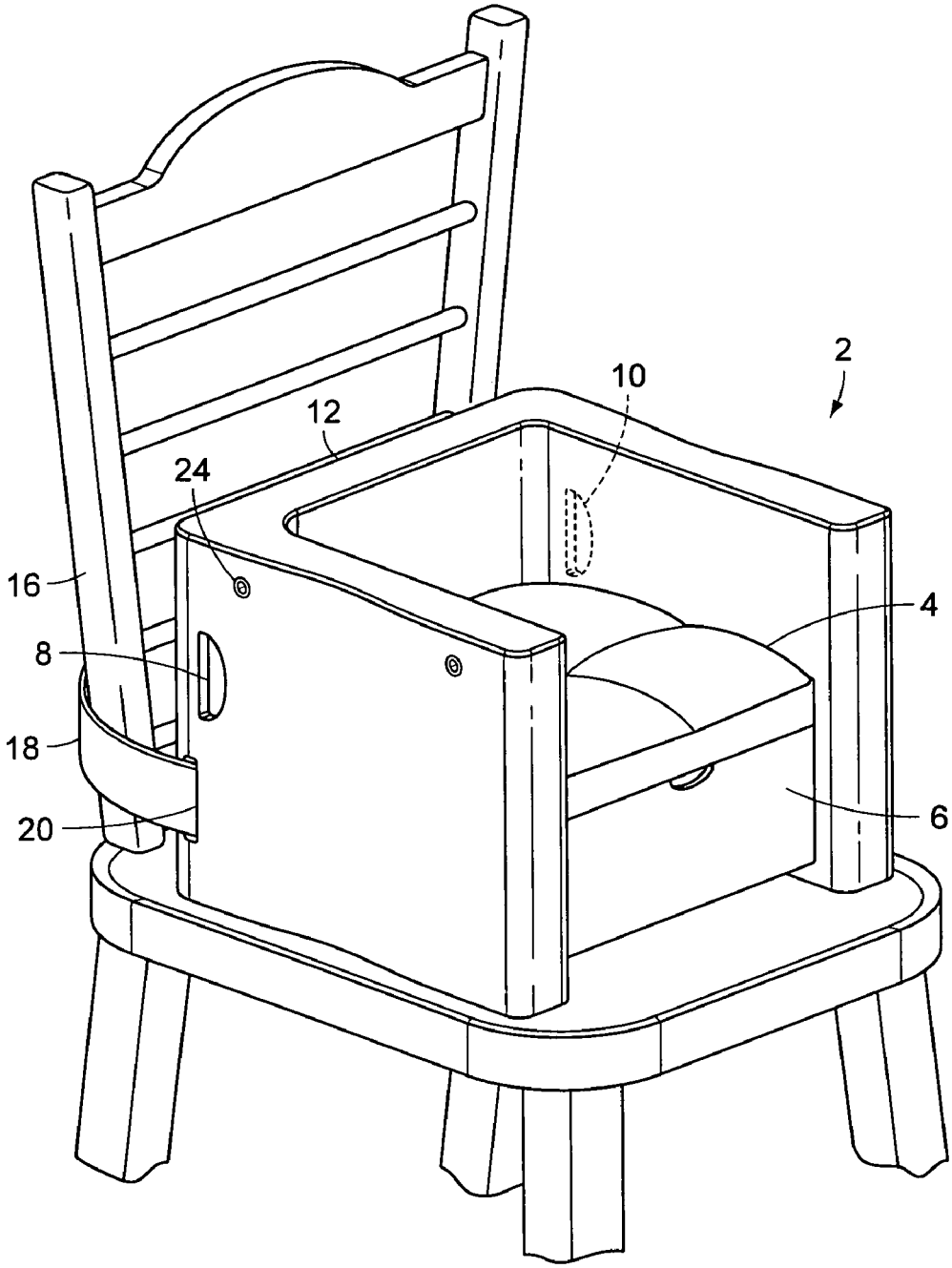
FIG. 1 shows a perspective view of the booster seat.

FIG. 1 shows a perspective view of the booster seat 2. Booster seat 2 is one-part of this two part invention, which is a system to make it easier for an adult to help an infant or toddler to eat at a table.

Booster seat 2 itself has two ends, a front end and a rear end, and two sides, a left side and a right side. Booster seat 2 also has a top end and a bottom end. Seat 4 of booster seat 2 is located on the top end of booster seat 2, with seat 4 being pivotally attached to the top end of booster seat 2. Below seat 4 is a small storage compartment 6 which allows an individual to store various items, as needed, within the booster seat 2.

Booster seat 2 has left handle 8 and right handle 10 attached to the left side and right side, respectively, of booster seat 2. In addition, booster seat 2 also has backing 12 which provides extra back support for an infant or toddler using the booster seat 2. Backing 12 is attached to the rear end of booster seat 2 and is also attached to the top end of the booster seat 2.

The rear end of booster seat 2 is attached to a chair 16 or other stationary object via seat belt 18, which is attached to the rear end of booster seat 2 also. Seat belt 18 would be inserted through holes 20 and 22, located on the rear end of booster seat 2, and would also be inserted to a stationary object 16 as needed.

The left side and the right side of booster seat 2 each has two snap holes 24, which are used to removably attach the spill-proof tray to when the present invention is not in use.

Figure 2:
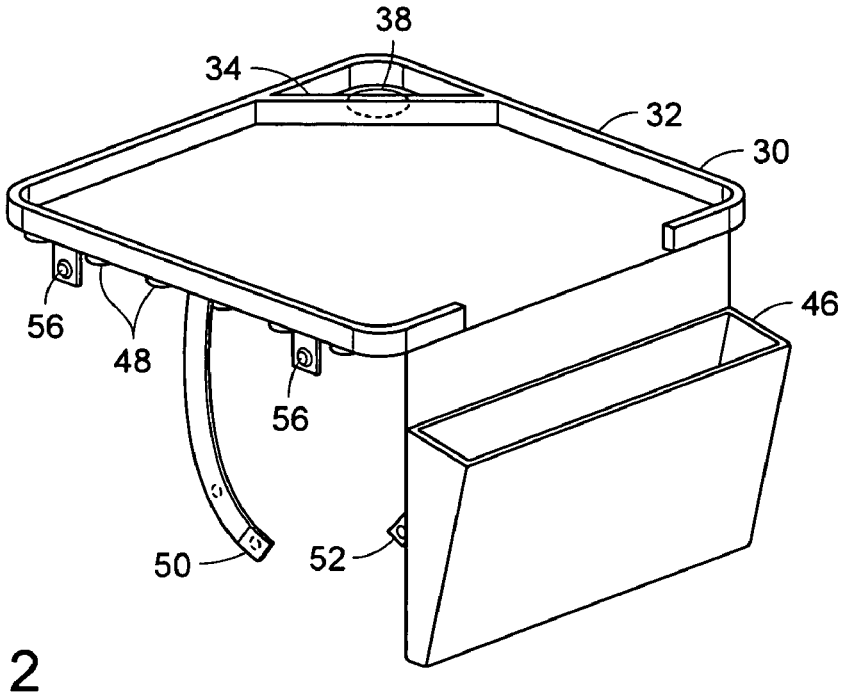
FIG. 2 shows a perspective view of the spill-proof tray.

FIG. 2 shows a perspective view of the spill-proof tray 30. Spill-proof tray 30 has two ends, a front end and a rear end, and two sides, a left side and a right side. Spill-proof tray 30 also has a top surface and a bottom surface and has four corners. Spill-proof tray 30 is designed to be used in conjunction with the booster seat 2 by placing the spill-proof tray 30 onto a table surface in front of the infant or toddler that is using the booster seat 2.

The top surface of the spill-proof tray 30 has a border 32 that travels all the way around the perimeter of the top surface, and would be about an inch high. This border 32 would catch any food and/or liquids that are spilled onto the spill-proof tray 30. The border 32 is not present for a short span along the front end of the border 32, which is the side that is facing the infant or toddler using the spill-proof tray 30.

One of the two corners near the rear end of the spill-proof tray 30 has an additional border 34, which when placed on the top surface of the spill-proof tray 30, creates a triangular area 36. In this triangular area 36, a cup holder 38 is present. The cup holder 38 allows for easy placement of a cup by an infant or toddler and creates a separate "area" that will prevent the rest of the top surface of the spill-proof tray 30 from getting wet if a cup with liquid is spilled in this area.

The front end of the spill-proof tray 30 has a catch-call tray 46 attached to it. Catch-all tray 46 is attached to the front end of the spill-proof tray 30 in a fixed position and serves to catch any food that is accidentally dropped off of the front end of the spill-proof tray 30.

The bottom surface of the spill-proof tray 30 has a plurality of suction cups 48, with one suction cup being located at each corner of the bottom surface of the spill-proof tray 30. The suction cups 48 are used once the spill-proof tray 30 is placed onto a table surface. Once this occurs, the spill-proof tray 30 can be pushed downward, hard, thereby allowing the suction cups to removably attach the spill-proof tray 30 to the table surface. The bottom surface of the spill-proof tray also has a pair of straps 50 and 52 which can be attached to one another once the spill-proof tray 30 has been placed on a table surface.

Figure 3:
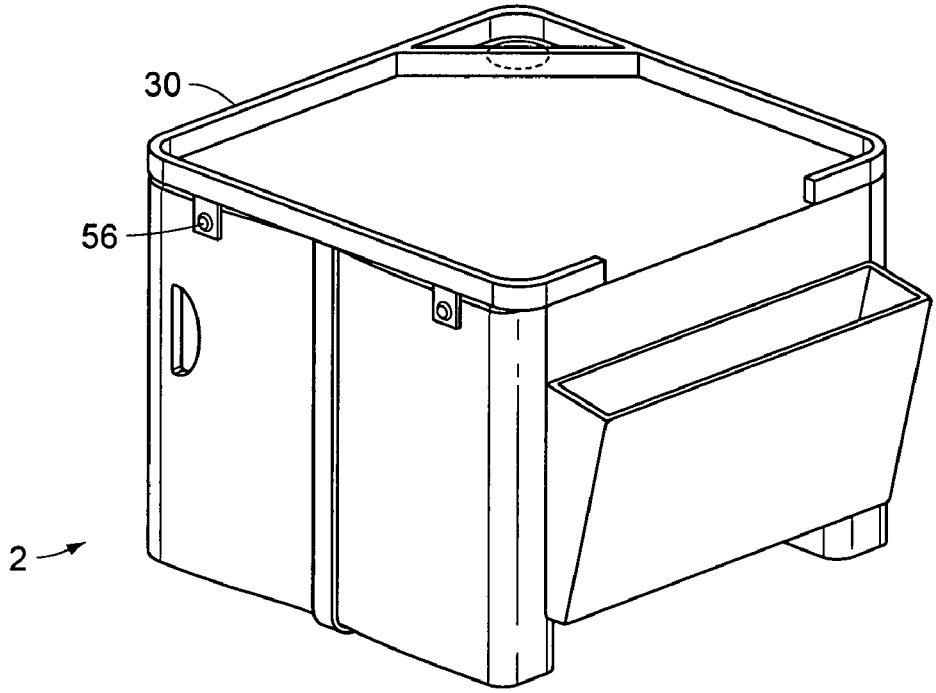
FIG. 3 shows a perspective view of the present invention after the spill-proof tray has been removably attached to the booster seat.

FIG. 3 shows a perspective view of the present invention after the spill-proof tray 30 has been removably attached to the booster seat 2. Once this occurs, the spill-proof tray 30 is attached to the booster seat 2 by a quartet of short snap attachments 56 which are attached to the bottom surface of the spill-proof tray 30. Each short snap attachment 56 is removably attached to a snap hole 24, thereby temporarily securing the two pieces of the present invention into once piece for easy transportation and storage.

What I claim as my invention is:

1. A combined booster seat and spill-proof tray comprising:

a booster seat having a front end, a rear end, a left side, a right side, a top end, and a bottom end, a seat pivotally attached to the top end of the booster seat, a storage compartment located within the booster seat, the storage compartment being located underneath the seat, a pair of handles comprising a left handle and a right handle, the left handle being located on the left side of the booster seat, the right handle being located on the right side of the booster seat, means for attaching the booster seat to a stationary object, a tray having a front end, a rear end, a left side, a right side, a top surface, and a bottom surface, a border attached to the top surface of the tray, the border traveling around a perimeter of the top surface of the tray, an additional border located on the top surface of the tray, the additional border creating a triangular area on the top surface of the tray, a catch-all tray attached to the front end of the tray, means for attaching the tray to a table surface such that the tray is substantially parallel to the table surface and the catch-all tray is substantially perpendicular to the table surface, and means for releasably securing the tray to the top of the booster seat such that the tray completely covers the top end of the booster seat and the catch-all tray completely covers the front end and storage compartment of the booster seat.

2. A combined booster seat and spill-proof tray according to claim 1 wherein the means for attaching the booster seat to a stationary object further comprises a pair of holes comprising a first hole and a second hole, the pair of holes being located near the rear end of the booster seat, a seat belt, the seat belt being inserted through the pair of holes, wherein the seat belt is attached to a stationary object.

3. A combined booster seat and spill-proof tray according to claim 1 wherein the means for attaching the tray to a table surface further comprises:

a plurality of suction cups attached to the bottom surface of the tray, wherein at least one suction cup is located near each corner of the bottom surface of the tray, further wherein the tray can be pushed downward once the bottom surface of the tray has been placed against a table surface.

4. A combined booster seat and spill-proof tray according to claim 1 wherein the means for attaching the tray to the booster seat comprises:

a quartet of snap holes located on the booster seat, and a quartet of snap attachments, each of the snap attachments being attached to the bottom surface of the tray, wherein each of the snap attachments is attachable to a snap hole.

* * * * *